US006612936B1

(12) United States Patent
Matias

(10) Patent No.: US 6,612,936 B1
(45) Date of Patent: Sep. 2, 2003

(54) GOLF CLUB WEIGHT

(76) Inventor: Melchor E. Matias, 57-31 256th St., Little Neck, NY (US) 11362

( * ) Notice: Subject to any disclaimer, the term of this patent is extended or adjusted under 35 U.S.C. 154(b) by 0 days.

(21) Appl. No.: 10/222,280

(22) Filed: Aug. 16, 2002

(51) Int. Cl.[7] ..... A63B 69/36
(52) U.S. Cl. ..... 473/256
(58) Field of Search ..... 473/256, 219, 473/226, 227, 229

(56) References Cited

U.S. PATENT DOCUMENTS

| | | | | | |
|---|---|---|---|---|---|
| 2,608,409 | A | | 8/1952 | Pinkerton | 273/35 |
| 3,351,346 | A | | 11/1967 | Strahan | 273/193 |
| 3,716,239 | A | * | 2/1973 | Goudreau | 473/256 |
| 3,743,297 | A | * | 7/1973 | Dennis | 473/242 |
| 4,045,034 | A | * | 8/1977 | Thomas | 473/231 |
| 4,364,560 | A | | 12/1982 | Gemmel | 273/1 |
| 4,588,191 | A | * | 5/1986 | Stewart | 473/256 |
| D290,150 | S | * | 6/1987 | Stewart | D21/759 |
| 4,809,975 | A | * | 3/1989 | Lee | 482/110 |
| 5,178,394 | A | | 1/1993 | Tanampai | 273/194 |
| 5,460,378 | A | | 10/1995 | Getts | 273/194 |
| 5,653,664 | A | * | 8/1997 | Jennings | 482/93 |
| 5,769,734 | A | * | 6/1998 | Qualey, Sr. | 473/233 |
| 5,776,006 | A | | 7/1998 | Gruber | 473/256 |
| 6,083,116 | A | * | 7/2000 | Loredo | 473/256 |
| 6,120,385 | A | | 9/2000 | Nemeckay | 473/256 |
| D438,585 | S | * | 3/2001 | Pelot | D21/753 |

* cited by examiner

*Primary Examiner*—Paul T. Sewell
*Assistant Examiner*—Nini F. Legesse
(74) *Attorney, Agent, or Firm*—Goldstein & Lavas, P.C.

(57) ABSTRACT

A golf club weight that is secured around a shaft of a golf club for aiding a golfer in swing training and warm up activities. The weight has a primary sleeve, a secondary sleeve, and a securement means. The securement means serves to interlock the primary sleeve and the secondary sleeve for securement around the golf club shaft. A set screw extends through the primary sleeve and, when tightened, may lock the secondary sleeve in place within the primary sleeve. Attachment weights may be added to the golf club weight to increase the overall weight applied to the golf club.

18 Claims, 8 Drawing Sheets

GOLF CLUB WEIGHT

BACKGROUND OF THE INVENTION

The invention relates to a golf club weight. In particular, the invention is a weight that is secured around a golf club shaft to aid a golfer in golf swing training and golf warm-up activities.

Golf is a popular sport and pastime for men and women of all ages. It is often difficult to excel at the game due to the high level of precision and accuracy necessary to complete a hole at or under par. Thus, golfers spend a lot of time practicing on their golf club swing in order to improve their game. A strong and accurate swing of the golf club is crucial to a good game. To this end, weights are often added to the golf club shaft during driving practice to aid the golfer in improving his or her swing. The added weight permits the golfer to achieve a greater distance in driving the ball, thereby decreasing the number of strokes necessary to sink the ball into the intended hole. Thus, it is advantageous for a golfer to use a heavier club during practice in order to increase the speed of his or her swing during a game. However, it is not always convenient to keep a heavier club available. Further, it is desirable to use a club which is heavier, but provides the same feel in all other respects.

Thus, there exists a need for a weight that is secured around a golf club shaft for enhancing a golfer's swing. Such a weight should be easily attachable to the club without interfering with the golfer's grip thereon. The amount of weight should be adjustable in order to accommodate the golfer's ability and strength.

U.S. Pat. No. 5,460,378 to Getts discloses a golf club counterweight that is releasably attachable to a golf club shaft. The counterweight may be relocated along the length of the shaft to affect the weight distribution of the golf club.

U.S. Pat. No. 5,178,394 to Tanampai discloses a shaft attachable golf club weight for adding weight to the club when swinging same. However, the weight has a clamp portion that attaches to the club, and a weight portion that extends substantially perpendicular to the club.

U.S. Pat. No. 3,351,346 to Strahan discloses a golf swing training device, particularly for use in perfecting an "inside-out" swing of a golf club.

U.S. Pat. No. 2,608,409 to Pinkerton discloses a golf swing trainer that provides an added weight on the golf club. However, the trainer device is designed to alert the golfer to faults being committed during the golf swing, and assist the golfer in rectifying said faults.

U.S. Pat. No. 5,776,006 to Gruber discloses a golf practice enhancer that is attached to a golf club shaft. The device has two weighted elements that are selectively coupled together, wherein the distance between the elements may be adjusted in order to position the device at any point along the shaft.

While these units may be suitable for the particular purpose employed, or for general use, they would not be as suitable for the purposes of the present invention as disclosed hereafter.

SUMMARY OF THE INVENTION

In view of the foregoing disadvantages inherent in the prior art, the present invention provides an improved golf club weight. As such, the general purpose of the present invention, which will be described subsequently in greater detail, is to provide a new and improved golf club weight which has all the advantages of the prior art and none of the disadvantages.

To attain this, the present invention essentially comprises a golf club weight that is secured around a shaft of a golf club for aiding a golfer in swing training and warm up activities. The weight has a primary sleeve, a secondary sleeve, and a securement means. The securement means serves to fix the relative angular positions of the primary sleeve and the secondary sleeve for securement around the golf club shaft. A set screw extends through the primary sleeve and, when tightened, fixes the relative positions of the secondary sleeve and the primary sleeve. Attachment weights may be added to the golf club weight to increase the overall weight applied to the golf club.

It is an object of the invention to produce a golf club weight that adds weight to a golf club for aiding a golfer during practice swings. Accordingly, the golf club weight has a primary sleeve and a secondary sleeve, with a longitudinal shaft slot which is selectively common to both sleeves. The shaft slot is selectively mateable with the golf club shaft, and the weight is secured thereto by rotating the secondary sleeve about the primary sleeve.

It is a further object of the invention to produce a golf club weight to which additional weights may be secured in order to increase the overall weight attached to the golf club shaft. Accordingly, additional weights may be selectively attached to either the primary or secondary sleeve of the golf club weight.

To the accomplishment of the above and related objects the invention may be embodied in the form illustrated in the accompanying drawings. Attention is called to the fact, however, that the drawings are illustrative only. Variations are contemplated as being part of the invention, limited only by the scope of the claims.

BRIEF DESCRIPTION OF THE DRAWINGS

In the drawings, like elements are depicted by like reference numerals. The drawings are briefly described as follows.

REFERENCE NUMERALS

Figure 1:
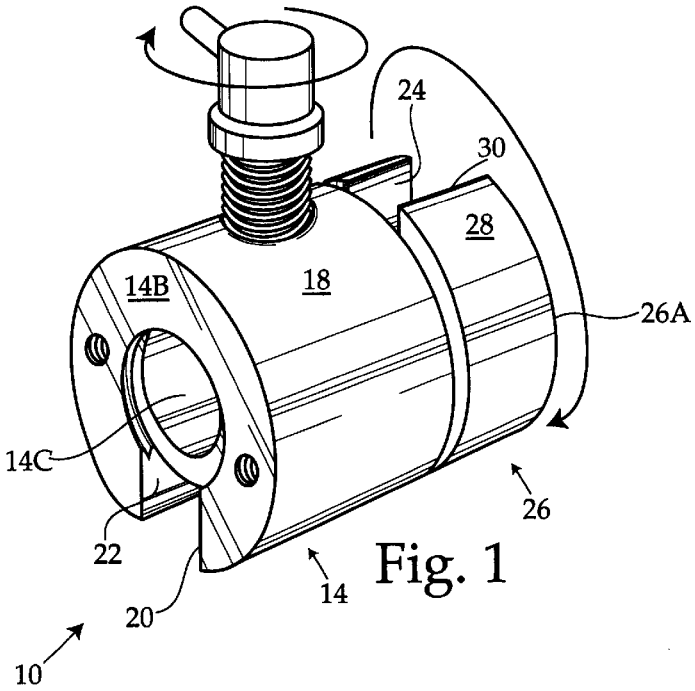
FIG. 1 is a perspective view of the golf club weight, illustrating selective rotation of the thumb crank and the secondary sleeve.

10 golf club weight
12 golf club
12S golf club shaft
14 primary sleeve
14T primary sleeve top surface
14B primary sleeve bottom surface
14C primary sleeve central bore
16 securement means
18 primary sleeve outer wall
20 primary sleeve inner wall
22 primary sleeve slot
26 secondary sleeve
26A secondary sleeve cap
26C secondary sleeve central bore
28 secondary sleeve outer wall
29 secondary sleeve shaft slot
30 secondary sleeve inner wall
32 secondary sleeve shaft
32A shaft outer surface
32B shaft inner surface
32C shaft bottom surface
34 non-abrasive material
36 threaded aperture
38 set screw
38A set screw protected end
38B set screw shoulder
40 thumb crank
42 attachment weight
42A attachment weight outer wall
42T attachment weight top surface
42B attachment weight bottom surface
42C attachment weight central bore
42S attachment weight shaft slot
44 threaded hole
46 screw
48 primary sleeve inner wall circumferential grooves
50 secondary sleeve shaft outer surface flange
52 securement screw
54 set screw protected end pad

DETAILED DESCRIPTION OF THE PREFERRED EMBODIMENTS

FIG. 1 illustrates a golf club weight 10 that is secured around a shaft 12S of a golf club 12 for aiding a golfer in swing training and warm up activities. The weight 10 essentially comprises a primary sleeve 14, a secondary sleeve 26, and a securement means 16, wherein the securement means 16 selectively interlocks the primary sleeve 14 and the secondary sleeve 26 for preventing relative longitudinal movement of the primary and secondary sleeves 14, 26.

The primary sleeve 14 has a top surface 14T, a bottom surface 14B, an outer wall 18, an inner wall 20, and a central bore 14C extending between the top surface 14T and the bottom surface 14B. The outer wall 18 and the inner wall 20 extend between the top and bottom surfaces 14T, 14B, with a longitudinal shaft slot 22 extending from the central bore 14C to the outer wall 18. The slot 22 is sized to allow the golf club shaft 12S to be inserted into the central bore 14C through said slot 22. In one embodiment of the golf club weight 10, the securement means 16 comprises threading around the inner wall 20 of the primary sleeve 14 to selectively accommodate the secondary sleeve 26, as will be described in greater detail hereinafter. Alternatively, in a second embodiment, the inner wall 20 of the primary sleeve 14 may be smooth, having an circumferential groove 48 at the primary sleeve bottom surface 14B and near the primary sleeve top surface 14T, said circumferential groove 48 encircling the inner wall 20.

Figure 2:
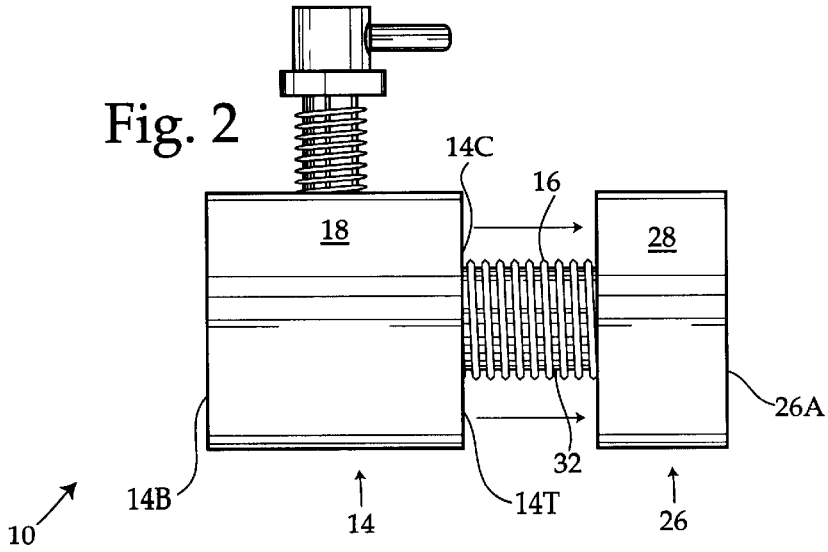
FIG. 2 is a side elevational view of the golf club weight, illustrating movement of the secondary sleeve about the primary sleeve.
Figure 3:
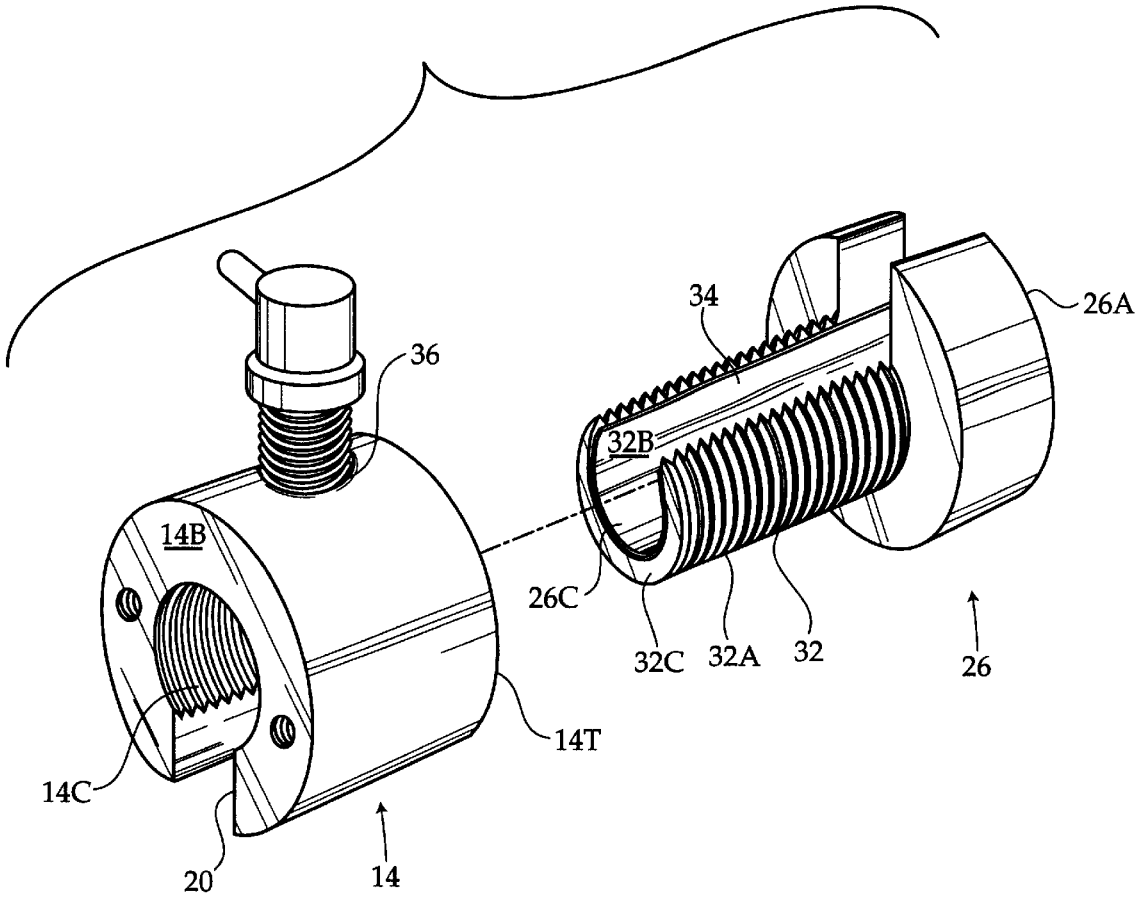
FIG. 3 is an exploded perspective view of the golf club weight, with the secondary sleeve detached from the primary sleeve.
Figure 8:
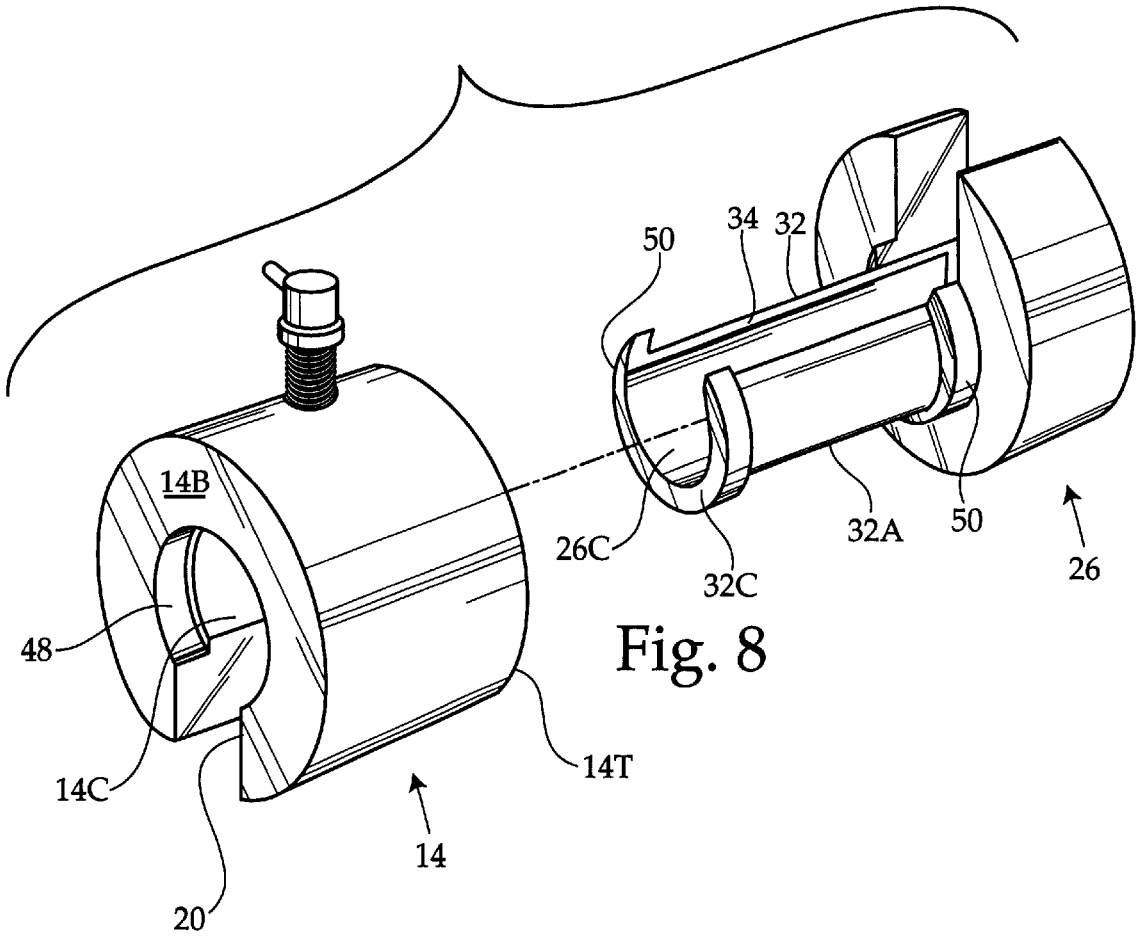
FIG. 8 is an exploded perspective view of an alternate embodiment of the golf club weight, with the secondary sleeve detached from the primary sleeve.
Figure 9:
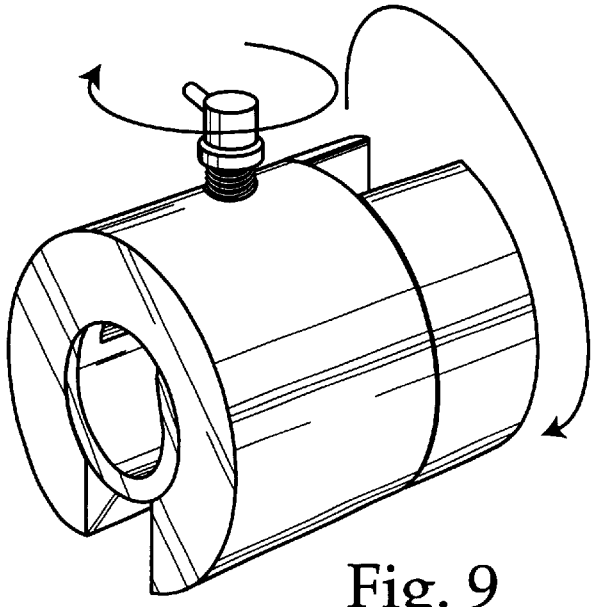
FIG. 9 is a perspective view of the alternate embodiment golf club weight, illustrating selective rotation of the thumb crank and the secondary sleeve.
Figure 10:
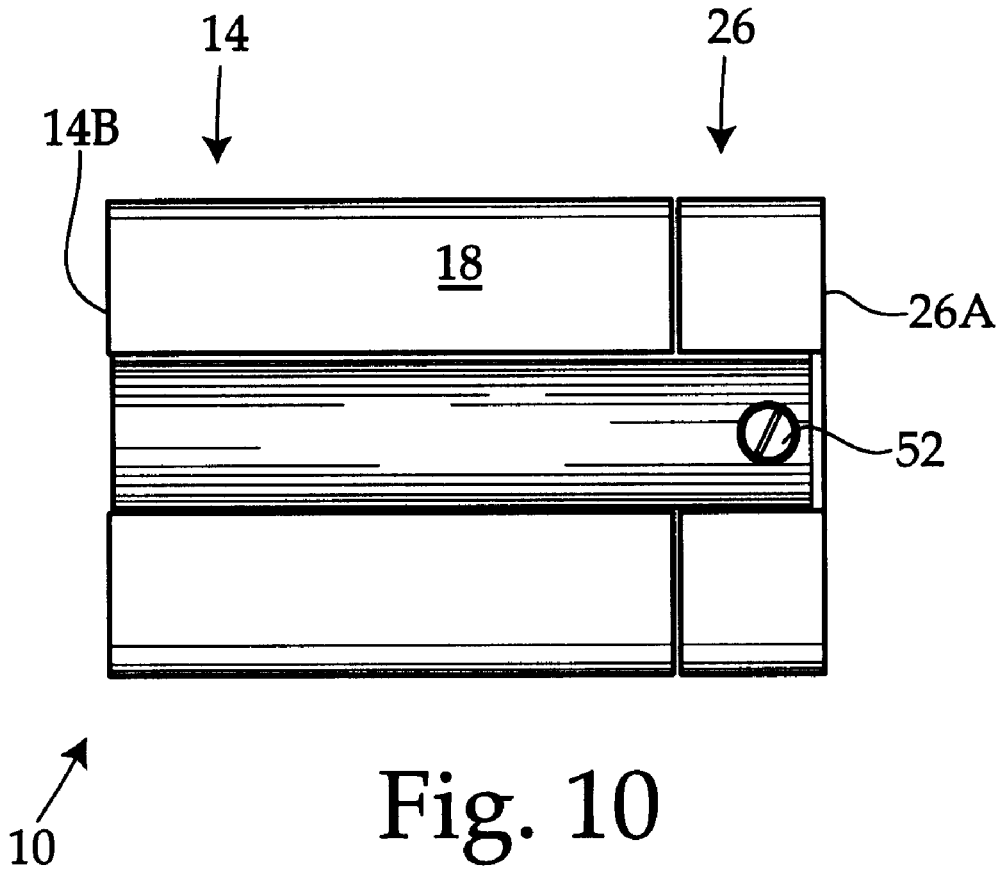
FIG. 10 is front elevational view of the alternate embodiment of the golf club weight with the shaft slots of the primary and secondary sleeves aligned.

Referring to FIG. 3, the secondary sleeve 26 has a cap 26A, an outer wall 28, and an inner wall 30. A secondary sleeve shaft 32 extends downward from the cap 26A, said shaft 32 having an outer surface 32A, an inner surface 32B, and a bottom surface 32C. A secondary sleeve central bore 26C extends from the secondary sleeve cap 26A to the shaft bottom surface 32C. A secondary sleeve shaft slot 29 extends longitudinally from the central bore 26C to the secondary sleeve outer wall 28 and the shaft outer surface 32A. The securement means 16 further comprises a corresponding means for the secondary sleeve 26, said securement means 16 allowing the primary sleeve 14 to engage the secondary sleeve 26. Referring to the first embodiment as shown in FIG. 3, the shaft outer surface 32A is threaded, thereby being selectively mateable with the inner wall 20 of the primary sleeve 14. As illustrated in FIG. 2, the threading serves as the securement means 16 for mating the primary sleeve 14 and the secondary sleeve 26, thus preventing uncontrolled longitudinal movement between the two sleeves 14, 26. In the second embodiment as illustrated in FIG. 8, the shaft outer surface 32A is smooth, having a flange 50 that extends outward from the cap 26A and from the shaft bottom surface 32C. When the secondary sleeve 26 is positioned within the primary sleeve 14, the flanges 50 engage the circumferential grooves 48, thereby securing the secondary sleeve 26 within the primary sleeve 14. Additionally, a securement screw 52 may be inserted through the secondary sleeve inner wall 30 into the primary sleeve 14. These two securement means 16 are offered as preferred embodiments of securement means for securing together the primary sleeve 14 and the secondary sleeve 26. Any number of different securement means may be utilized.

The length of the shaft 32 is equivalent to the length of the primary sleeve 14. Thus, when the shaft 32 is completely secured within the primary sleeve 14, the cap 26A rests on top of the primary sleeve top surface 14T, and the shaft bottom surface 32C is flush with the primary sleeve bottom surface 14B. The secondary sleeve cap 26A has the same diameter as the primary sleeve 14, and the secondary sleeve shaft 32 has substantially the same diameter as the primary sleeve central bore 14C. Thus, the secondary sleeve shaft 32 is sized to fit within the primary sleeve 14 and rotate therein. In the first embodiment, the central bore 26C of the secondary sleeve 26 is not threaded in order to accommodate the golf club shaft 12S without damaging the finish on said shaft 12S. A non-abrasive material 34, preferably felt or velvet, may line the secondary sleeve central bore 26C to protect the golf club shaft 12S.

Figure 7:
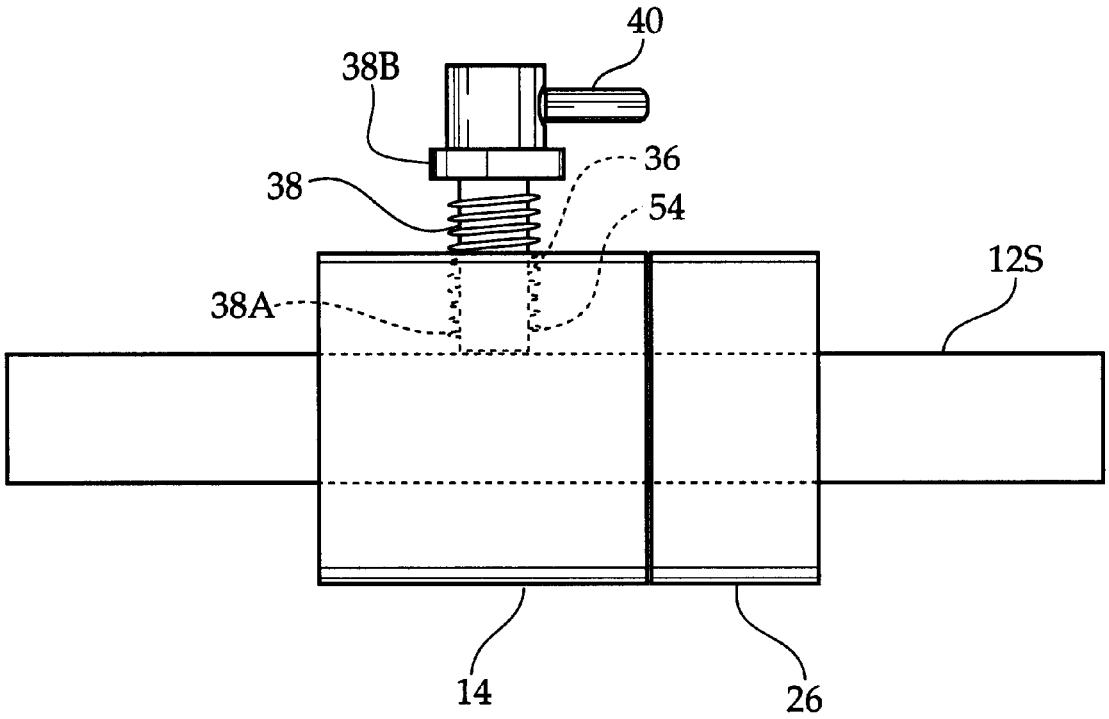
FIG. 7 is a side elevational view of the golf club weight in place about the golf club shaft, illustrating engagement of the set screw with the golf club shaft.

A threaded aperture 36 extends transversely through the primary sleeve 14, from the outer wall 18 to the inner wall 20. This aperture 36 is sized to accommodate a set screw 38. The set screw 38 is threaded into the aperture 36, from the outer wall 18 towards the inner wall 20. The set screw 38 has a protected end 38A, a shoulder 38B, and a thumb crank 40 positioned on top of the shoulder 38B. The protected end 38A has a pad 54 which directly engages the golf club 12 when the set screw 38 is tightened thereagainst to prevent scratching or marring of the golf club shaft 12S. The thumb crank 40 is engaged by a user in order to thread the screw 38 into the aperture 36. The length of the set screw 38 is longer than the distance between the primary sleeve outer wall 18 and inner wall 20. When the secondary sleeve shaft 32 is secured within the primary sleeve 14, the set screw protected end 38A engages the shaft outer surface 32A, thereby selectively locking the secondary sleeve shaft 32 within the primary sleeve 14, as illustrated in FIG. 7. Bringing the set screw end 38A into contact with the shaft outer surface 32A prevents the shaft 32 from moving within the primary sleeve central bore 14C.

Figure 5:
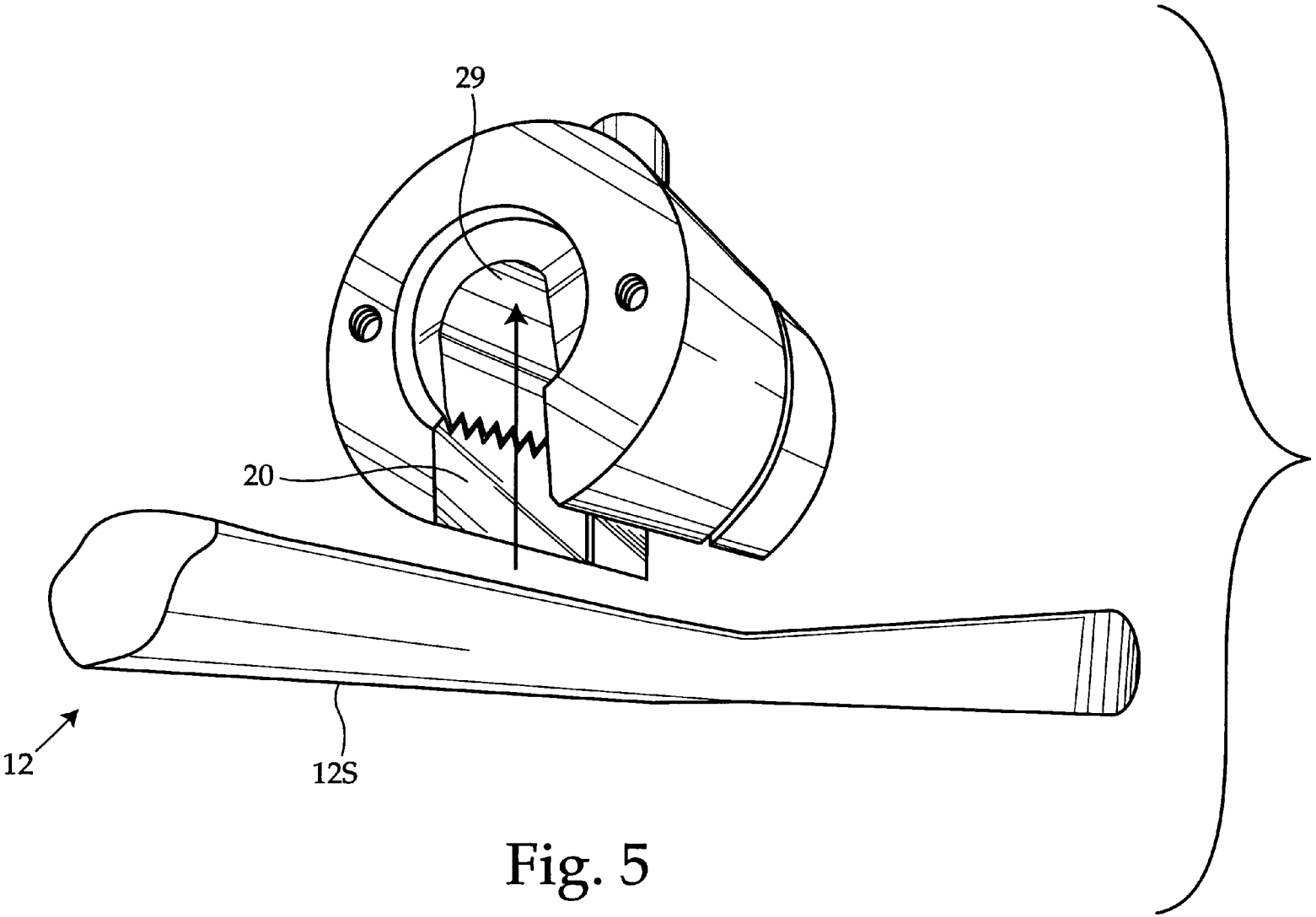
FIG. 5 is a perspective view of the golf club weight, illustrating the mating of the weight with the shaft of a golf club.
Figure 6:
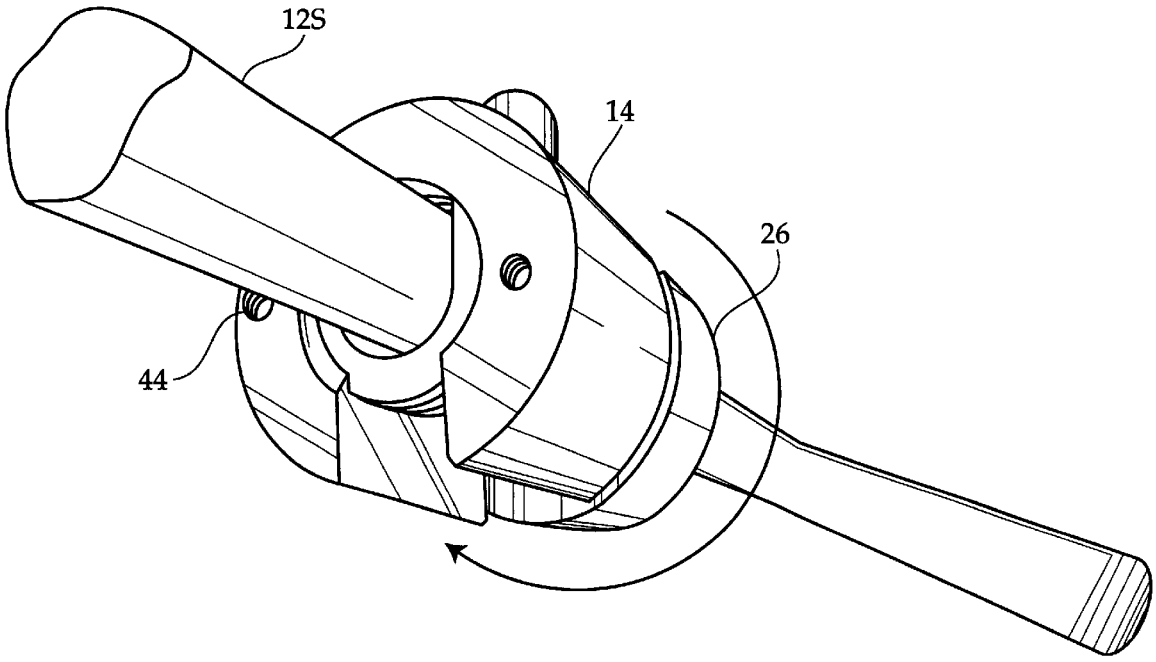
FIG. 6 is a perspective view of the golf club weight, illustrating securement of the weight around the golf club shaft.

The width of the primary sleeve shaft slot 22 is the same as the secondary sleeve shaft slot 29. Thus, when the shaft 32 is secured within the primary sleeve central bore 14C, the shaft slots 22, 29 may be selectively aligned, as illustrated in FIG. 5. Once aligned, the golf club shaft 12S may be inserted through the shaft slots 22, 29, said golf club shaft 12S being brought into contact with the secondary sleeve central bore 26C. When the golf club shaft 12S is in place, the secondary sleeve 26 is rotated less than 360°, thus misaligning the shaft slots and locking the weight 10 around the golf club 12, as illustrated in FIG. 6. The thumb crank 40 is then turned until the set screw protected end 38A engages the shaft outer surface 32A and locks same in place.

Figure 4:
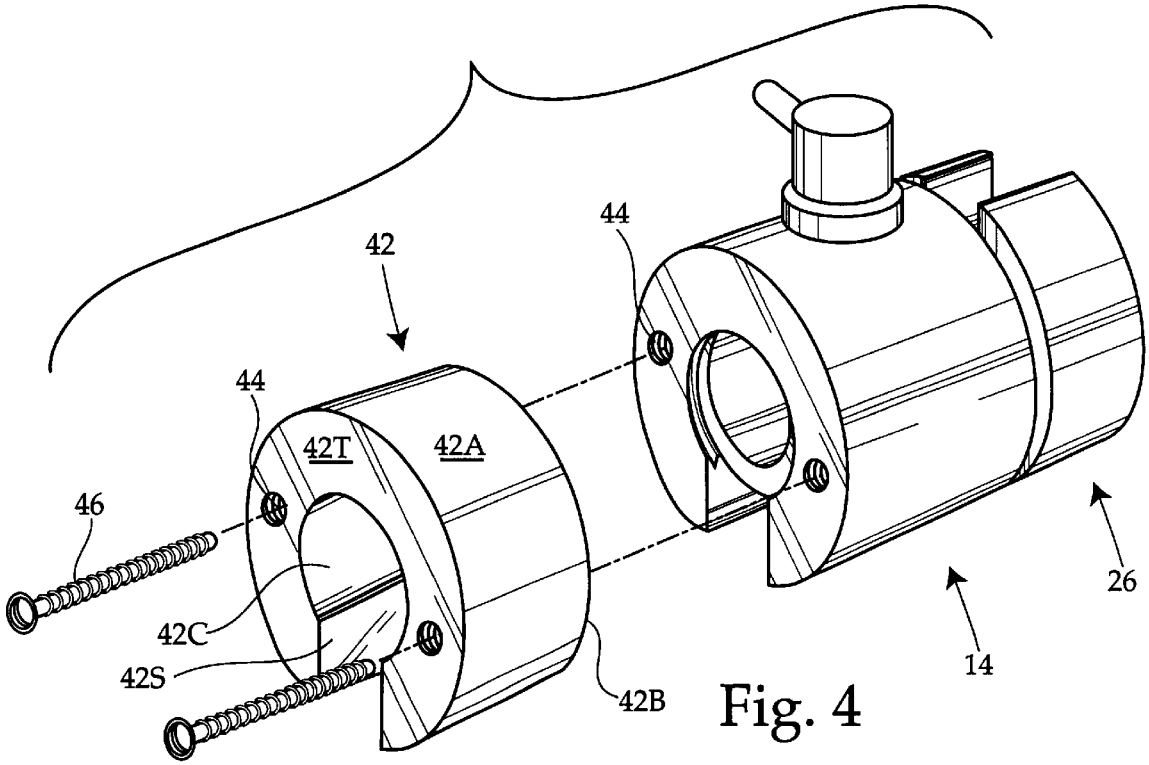
FIG. 4 is an exploded perspective view of the golf club weight, illustrating attachment of an additional weight to the primary sleeve.

In addition to the golf club weight 10 as described above, an attachment weight 42 may be added thereon, as illustrated in FIG. 4. The attachment weight 42 has a similar construction as the primary sleeve 14, said attachment weight 42 having an outer wall 42A, a top surface 42T, a bottom surface 42B, a central bore 42C extending longitudinally between the top and bottom surfaces 42T, 42B, and a shaft slot 42S extending longitudinally from the central bore 42C to the outer wall 42A. A pair of threaded holes 44 extend through the attachment weight 42, from the top surface 42T to the bottom surface 42B, said holes 44 sized to accommodate a screw 46. The holes 44 are spaced on either side of the central bore 42C. Corresponding holes 44 extend upward from the primary sleeve bottom surface 14B. Thus, when the attachment weight 42 is placed against the primary sleeve 14, with the shaft slots 22, 42S aligned, screws 46 may be threaded through the attachment weight 42 into the primary sleeve 14, thereby securing the attachment weight 42 to the golf club weight 10. It should be noted that the above is only a description of a preferred embodiment. The attachment weight may be secured to the golf club weight by a number of different methods.

In conclusion, herein is presented a golf club weight for securement about a golf club shaft. The invention is illustrated by example in the drawing figures, and throughout the written description. It should be understood that numerous variations are possible, while adhering to the inventive concept. Such variations are contemplated as being a part of the present invention.

What is claimed is:

1. A golf club weight for use with a golf club, the golf club having a shaft, comprising:

a primary sleeve, the primary sleeve having a top surface, a bottom surface, an outer wall, an inner wall, said walls extending longitudinally between the top and bottom surfaces, a central bore also extending between the top and bottom surfaces, and a longitudinal primary sleeve shaft slot extending from the central bore to the outer wall, said slot sized to allow the golf club shaft to be inserted into the central bore through said slot;

a secondary sleeve, the secondary sleeve having an outer wall, an inner wall, a cap, and a shaft extending downward from the cap, the cap having same diameter as the primary sleeve and a larger diameter than the shaft, and the shaft sized to fit within the primary sleeve central bore and rotatable within the primary sleeve, said shaft having an outer surface, an inner surface, and a bottom surface, a secondary sleeve central bore extending longitudinally from the cap to the shaft bottom surface, and a secondary sleeve shaft slot extending longitudinally from the central bore to the secondary sleeve outer wall and the shaft outer surface; and a securement means, the securement means selectively interlocking the primary sleeve and the secondary sleeve for preventing relative longitudinally movement of the primary and secondary sleeves.

2. The golf club weight as recited in claim 1, wherein the securement means comprises threading on the inner wall of the primary sleeve and threading on the outer surface of the secondary sleeve shaft, wherein the shaft is selectively mateable with the primary sleeve and the securement means prevents uncontrolled longitudinal movement between the sleeves.

3. The golf club weight as recited in claim 2, wherein the primary sleeve further comprises:

a threaded aperture, the aperture extending transversely through the primary sleeve, from the outer wall to the inner wall; and a set screw, the set screw being selectively mateable with the threaded aperture, said set screw having a protected end, a shoulder, and a thumb crank positioned on top of the shoulder, wherein the thumb crank is engaged by the user to thread the screw into the aperture.

4. The golf club weight as recited in claim 3, wherein the length of the set screw is longer than the distance between the outer wall and the inner wall of the primary sleeve, wherein when the secondary sleeve shaft is secured within the primary sleeve, the set screw protected end engages the shaft outer surface, thereby selectively locking the secondary sleeve shaft within the primary sleeve.

5. The golf club weight as recited in claim 4, wherein the protected end of the set screw has a pad which directly engages the golf club when the set screw is tightened thereagainst to prevent damage to the golf club shaft.

6. The golf club weight as recited in claim 5, wherein the length of the secondary sleeve shaft is equivalent to the length of the primary sleeve, wherein when the secondary sleeve shaft is completely threaded into the primary sleeve, the secondary sleeve cap rests on top of the primary sleeve top surface, and the shaft bottom surface is flush with the primary sleeve bottom surface.

7. The golf club weight as recited in claim 6, wherein the secondary sleeve central bore is lined with a non-abrasive material to protect the golf club shaft.

8. The golf club weight as recited in claim 1, wherein the securement means comprises circumferential grooves at the bottom edge and near the top edge of the primary sleeve and flanges extending outward from the shaft top edge and the shaft bottom edge, wherein the shaft flanges engage the primary sleeve circumferential grooves, thus selectively mating the primary sleeve and preventing longitudinal movement between the sleeves.

9. The golf club weight as recited in claim 8, wherein the primary sleeve further comprises:

a threaded aperture, the aperture extending transversely through the primary sleeve, from the outer wall to the inner wall; and a set screw, the set screw being selectively mateable with the threaded aperture, said set screw having a protected end, a shoulder, and a thumb crank positioned on top of the shoulder, wherein the thumb crank is engaged by the user to thread the screw into the aperture.

10. The golf club weight as recited in claim 9, wherein the length of the set screw is longer than the distance between the outer wall and the inner wall of the primary sleeve, wherein when the secondary sleeve shaft is secured within the primary sleeve, the set screw protected end engages the shaft outer surface, thereby selectively locking the secondary sleeve shaft within the primary sleeve.

11. The golf club weight as recited in claim 10, wherein the protected end of the set screw has a pad which directly engages the golf club when the set screw is tightened thereagainst to prevent damage to the golf club shaft.

12. The golf club weight as recited in claim 11, wherein the length of the secondary sleeve shaft is equivalent to the length of the primary sleeve, wherein when the secondary sleeve shaft is secured within the primary sleeve, the secondary sleeve cap rests on top of the primary sleeve top surface, and the shaft bottom surface is flush with the primary sleeve bottom surface.

13. The golf club weight as recited in claim 12, wherein the secondary sleeve central bore is lined with a non-abrasive material to protect the golf club shaft.

14. The golf club weight as recited in claim 1, further comprising an attachment weight that may be added to the golf club weight to increase the weight thereof, said attachment weight having an outer wall, a top surface, a bottom surface, a central bore extending longitudinally between the top and bottom surfaces, and a shaft slot extending longitudinally from the central bore to the outer wall.

15. The golf club weight as recited in claim 14, wherein the attachment weight further comprises a pair of threaded holes, the holes extending through the attachment weight, from the top surface to the bottom surface, said holes sized to accommodate a screw.

16. The golf club weight as recited in claim 15, wherein the primary sleeve further comprises holes corresponding to the attachment weight holes, wherein when the attachment weight is placed against the primary sleeve, with the shaft slots aligned, screws may be threaded through the attachment weight into the primary sleeve, thereby securing the attachment weight to the golf club weight.

17. A method of adding weight to a golf club shaft using a golf club weight, the golf club having a golf club shaft, and the golf club weight comprising a primary sleeve and a secondary sleeve, the primary sleeve having a primary sleeve shaft slot, and the secondary sleeve having a cap, a shaft extending down from the cap, a secondary sleeve shaft slot, and a secondary sleeve central bore, comprising the steps of:

aligning the secondary sleeve shaft slot with the primary sleeve shaft slot by rotating the secondary sleeve within the primary sleeve;

inserting the golf club shaft through the shaft slots into the secondary sleeve central bore;

misaligning the shaft slots by rotating the secondary sleeve about the primary sleeve, thereby locking the shaft within the secondary sleeve central bore;

practicing a golf swing using the golf club.

18. The method of adding weight to a golf club shaft using a golf club weight as recited in claim 17, wherein the weight further comprises a thumb crank and a set screw, the set screw having a protected end opposite the thumb crank, and the secondary sleeve shaft having an outer surface, wherein the step of practicing a golf swing using the golf club is immediately preceded by the step of:

locking the secondary sleeve in place within the primary sleeve by turning the thumb crank and engaging the protected end of the set screw against the shaft outer surface.

* * * * *